US006423182B1

(12) United States Patent
Furunaga et al.

(10) Patent No.: US 6,423,182 B1
(45) Date of Patent: Jul. 23, 2002

(54) SURFACE-SIZING AGENT AND RECORDING PAPER COMPRISING SAME

(75) Inventors: Toshikatsu Furunaga, Tokyo; Shigeru Yamanaka, Kanagawa-ken, both of (JP)

(73) Assignees: Space Environmental Technology Company, Inc.; Ajinomoto Co., Inc., both of Tokyo (JP)

( * ) Notice: Subject to any disclaimer, the term of this patent is extended or adjusted under 35 U.S.C. 154(b) by 0 days.

(21) Appl. No.: 09/781,267

(22) Filed: Feb. 13, 2001

(30) Foreign Application Priority Data

Feb. 14, 2000 (JP) ..... 2000-035986

(51) Int. Cl.[7] ..... D21M 21/50

(52) U.S. Cl. ..... 162/135; 162/99; 162/129; 162/130; 162/148; 162/164.1; 162/164.6; 162/168.2; 162/168.3; 162/176

(58) Field of Search ..... 106/163.01; 162/135, 162/99, 164.1, 129, 130, 148, 164.6, 168.2, 168.3

(56) References Cited

U.S. PATENT DOCUMENTS 4,861,427 A * 8/1989 Johnson et al. ..... 162/135
4,888,092 A * 12/1989 Prusas et al. ..... 162/135
4,952,278 A * 8/1990 Gregory et al. ..... 162/187
5,403,445 A * 4/1995 Shimomura et al. ..... 162/189
5,964,983 A * 10/1999 Dinand et al. ..... 162/187
6,183,596 B1 * 2/2001 Matsuda et al. ..... 162/176
6,312,669 B1 * 11/2001 Cantiani et al. ..... 162/187

FOREIGN PATENT DOCUMENTS

JP 59-35977 2/1984 ..... B41M/5/00
JP 1-135682 5/1989 ..... B41M/5/00
JP 6-287887 10/1994 ..... D21H/17/20
JP 6-287888 10/1994 ..... D21H/17/67

* cited by examiner

*Primary Examiner*—Peter Chin
(74) *Attorney, Agent, or Firm*—Sughrue Mion, PLLC

(57) ABSTRACT

A surface-sizing agent for providing a recording paper contains bacterial cellulose and/or plant-originated fine fibrous cellulose (having an average diameter of 10 $\mu$m or less), and a cationic polymer. The cationic polymer may be at least partially bonded to the bacterial cellulose and/or the plant-originated fine fibrous cellulose. The cationic polymer may be an acrylic polymer, a vinyl polymer or an allyl polymer each comprising a quaternary amino group.

11 Claims, 3 Drawing Sheets

SURFACE-SIZING AGENT AND RECORDING PAPER COMPRISING SAME

FIELD OF THE INVENTION

The present invention relates to a surface-sizing agent for providing inexpensive plain papers capable of being printed with high-quality, blur-free image, and a recording paper comprising such a surface-sizing agent.

BACKGROUND OF THE INVENTION

Inkjet printers are widely used not only as output means for personal computers, but also as means for printing on media of various materials. Widely used as inks for inkjet printers now are those composed of organic dyes dissolved in water or other solvents, and organic dyes include azo dyes, anthraquinone dyes, indigo dyes, phthalocyanine dyes, carbonium ion dyes, nitro dyes, quinoline dyes, naphthoquinone dyes, etc.

To clearly develop the color of the above inks while preventing the printed ink from blurring, so-called coated papers comprising ink-bearing layers made of high-water-absorption resins on surface, as disclosed by Japanese Patent Laid-Open Nos. 59-35977 and 1-135682, are used for inkjet printers. Such coated papers, however, are high in production cost because of special coatings, and lack in such hand as that of plain papers. In addition, the coated papers produce large amounts of ash when burned, leading to undesirable results in waste treatment. Accordingly, demand is now mounting on commonly usable, inexpensive plain papers suitable for inkjet printers.

When a plain paper is used for an inkjet printer, however, the ink diffuses along fibers of the paper in the course of absorption into the paper, resulting in ink dots with excess blur, and so-called feathering such as irregular peripheries, indistinct outlines, etc. Thus, clear letters and image cannot easily be obtained.

In view of such problems, Japanese Patent Laid-Open Nos. 6-287887 and 6-287888 disclose bacterial cellulose-containing papers produced from a pulp slurry containing fine fibrous cellulose such as bacterial cellulose. However, such inner sizing provides insufficient sizing effects, failing to provide full sizing effects.

Accordingly, an object of the present invention is to provide an inexpensive surface-sizing agent with which plain papers are coated or impregnated to turn them to recording papers capable of providing blur-free, high-quality image while preventing ink dots formed by ink drops from spreading.

Another object of the present invention is to provide a recording paper comprising such a surface-sizing agent.

SUMMARY OF THE INVENTION

As a result of intensive research in view of the above objects, the inventors have found that the application of a surface-sizing agent comprising bacterial cellulose and/or plant-originated fine fibrous cellulose (having an average diameter of 10 $\mu$m or less) and a cationic polymer to a raw paper provides a recording paper with reduced ink blurring. The present invention has been completed based on this finding.

The recording paper according to the present invention is characterized by being sized with a surface-sizing agent comprising bacterial cellulose and/or plant-originated fine fibrous cellulose (having an average diameter of 10 $\mu$m or less) and a cationic polymer.

Fibers of broadleaf tree pulp are generally as wide as about 30 $\mu$m. Therefore, when printing is made on plain papers formed from broadleaf tree pulp, an ink blurs along paper fibers, resulting in so-called feathering, namely ink dots with excess blur, irregular peripheries, indistinct outlines, etc. According to the present invention, however, a fine network of fine fibrous cellulose is formed on a surface of a paper by sizing, solving these problems.

Because the surface-sizing agent is coated on a surface of a paper according to the present invention, the fine fibrous cellulose remains in the vicinity of a paper surface. Therefore, even an extremely small amount of fine fibrous cellulose can provide the same effects as those of the conventional internal sizing.

Because the sizing agent of the present invention comprises a cationic polymer, coloring materials contained in an ink are associated with the cationic polymer by ionic interaction near a surface of a recording paper while penetrating into the recording paper, resulting in instantaneous separation from a solution phase, which leads to further improvement in fixing and color development of the ink. The cationic polymer preferably is at least partially bonded to the fine fibrous cellulose. With the cationic polymer fixed to the fine fibrous cellulose, the cationic polymer remains near a paper surface together with the bacterial cellulose, resulting in difficulty in penetrating into the raw paper. Therefore, enough effects can be obtained by a smaller amount of the cationic polymer.

DETAILED DESCRIPTION OF PREFERRED EMBODIMENTS

Figure 1:
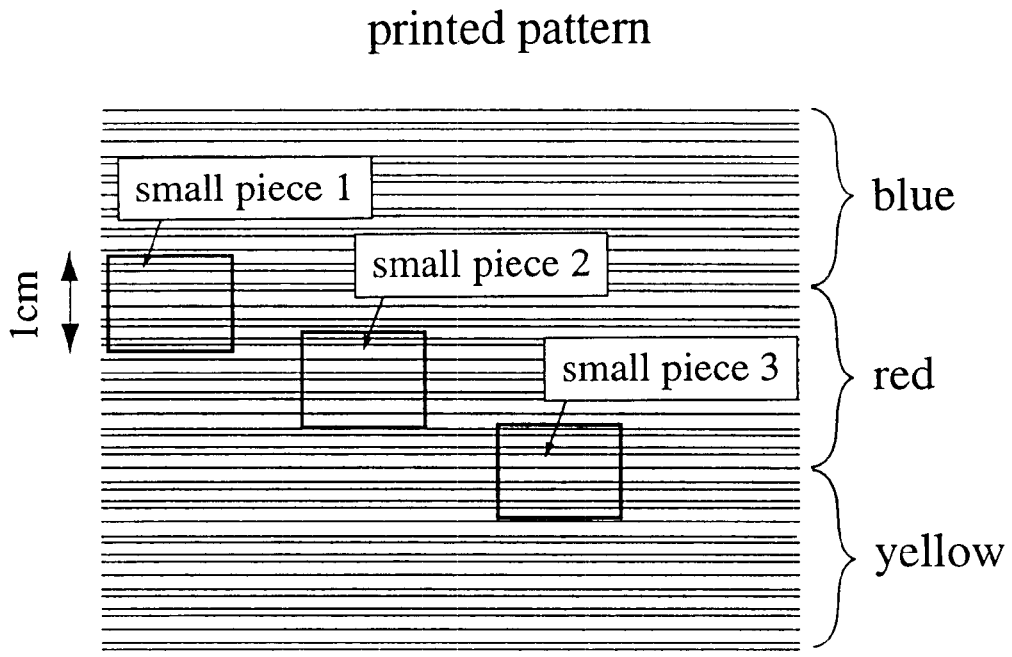
FIG. 1 is a view showing a pattern of printed letters used for the measurement of line width.
Figure 2:
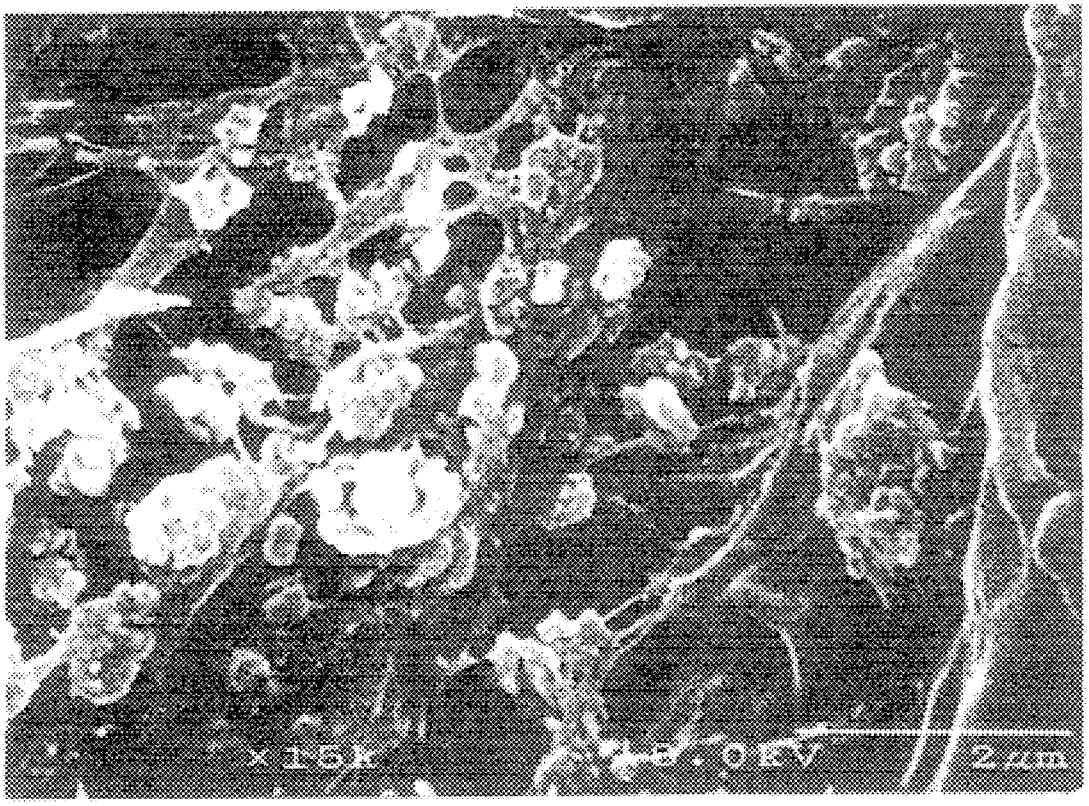
FIG. 2 is a surface SEM photograph of a paper sized with bacterial cellulose.
Figure 3:
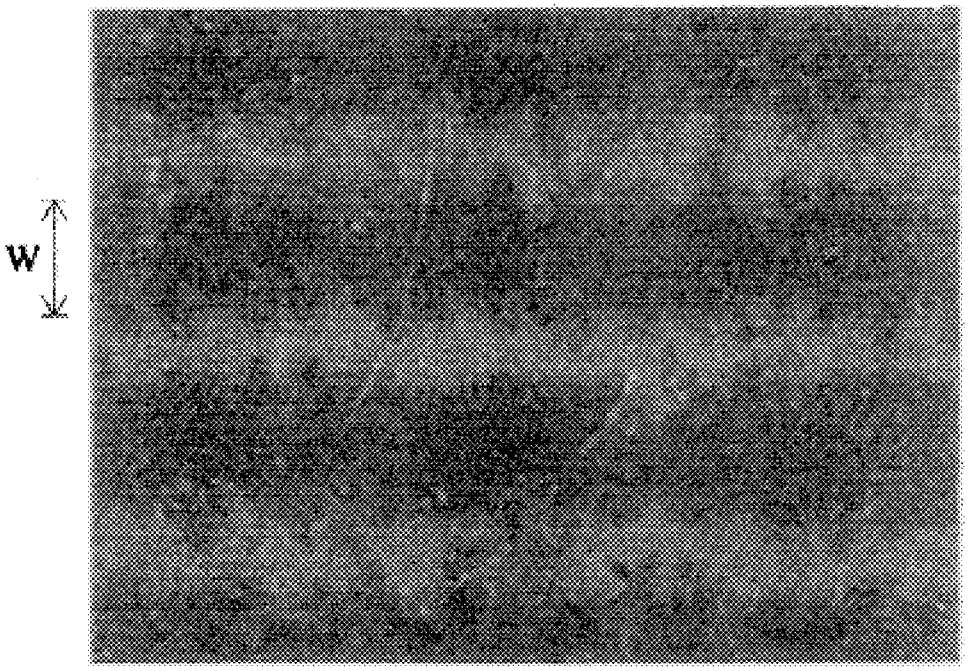
FIG. 3 is an enlarged view showing the width of printed letters on a paper sized with bacterial cellulose (EXAMPLE 1)
Figure 4:
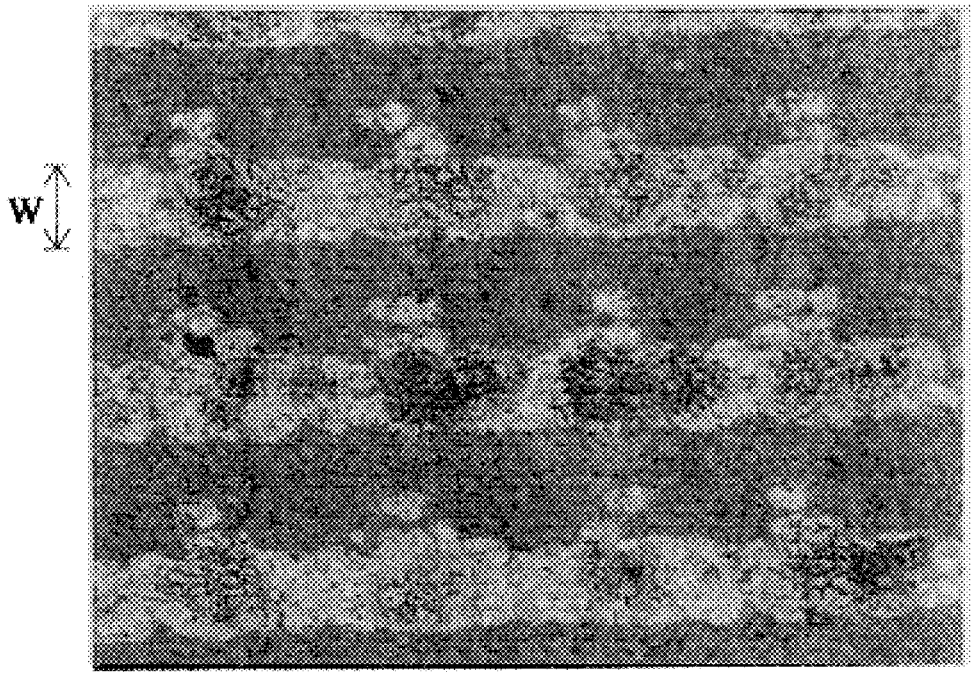
FIG. 4 is an enlarged view showing the width of printed letters on a commercially available coated paper (COMPARATIVE EXAMPLE 4).

The surface-sizing agent and the recording paper of the present invention will be explained in detail below.

[A] Surface-sizing Agent

The surface-sizing agent of the present invention comprises fine fibrous cellulose and a cationic polymer. To enhance the fixing and color development of ink, it is preferable that the cationic polymer is at least partially bonded to the fine fibrous cellulose.

(1) Fine Fibrous Cellulose

The fine fibrous cellulose is bacterial cellulose and/or plant-originated fine fibrous cellulose (having an average diameter of 10 $\mu$m or less). From the aspect of narrow fiber size distribution, the bacterial cellulose is more preferable. In the present invention, these fine fibrous celluloses may be used alone or in combination.

The bacterial cellulose is composed of ribbon-shaped microfibril of 1–20 nm in thickness and 10 nm to 1 $\mu$m in width. Those obtained by microorganism cultivation are in a gel stage, having a water content (w/v) of 95% or more.

The bacterial cellulose is cellulose or heteropolysaccharide having cellulose as a main chain, and β-1,3 or β-1,2 glucan, etc. In the case of heteropolysaccharide, constituents other than cellulose are hexoses, pentoses and organic acids such as mannose, fructose, galactose, xylose, arabinose, rhamnose, glucuronic acid, etc. These polysaccharides may be single materials or mixtures of two or more polysaccharides hydrogen-bonded to each other. Any bacterial cellulose may be used as long as they are as defined above.

Microorganisms generating such bacterial celluloses are not restrictive, and they may be Acetobacter aceti subsp xylinum ATCC 10821 or *Acetobacter pasteurianus, Acetobacter rancens, Sarcina ventriculi, Bacterium xyloides,* Pseudomonas-group bacteria, Agrobacterium-group bacteria, which can generate bacterial cellulose.

The cultivation of these microorganisms and the formation and storage of bacterial cellulose can be achieved by usual cultivation methods. Specifically, microorganisms are inoculated to usual media containing carbon sources, nitrogen sources, inorganic salts, and if necessary, organic micronutrients such as amino acids, vitamins, etc., and left to stand or slowly stirred while passing air.

The carbon sources may be glucose, sucrose, maltose, hydrolyzed starch, molasses, treacle, etc., and ethanol, acetic acid, citric acid, etc. may be used alone or together with the above sugars. The nitrogen sources may be organic or inorganic nitrogen sources including ammonium salts such as ammonium sulfate, ammonium chloride, ammonium phosphate, etc., nitrates, urea, peptone, etc. The inorganic salts may be phosphates, magnesium salts, calcium salts, iron salts, manganese salts, etc. The organic micro-nutrients may be amino acids, vitamins, aliphatic acids, nucleic acids, and peptones, casamino acid, yeast extracts, hydrolyzed soy protein, etc. containing such nutrients. When nutritional mutants needing amino acids, etc. for growth are used, necessary nutrients should further be added.

Usual cultivation conditions may be used to carry out stationary culture or air-stirring culture at pH of 5–9 and at a temperature of 20–37° C. for 1–30 days. In the case of stationary culture, the bacterial cellulose is stored in a mat or gel state on an incubation surface. Also, in the case of air-stirring cultivation, the bacterial cellulose is produced in a bulk state of various sizes dispersed in a cultivation liquid. The resultant bacterial cellulose is usually composed of microfibril 1–20 nm in thickness and 10–200 nm in width (Japanese Patent Laid-Open No. 62-36467, U.S. Pat. No. 4,863,565). By adding cell division inhibitors such as chloramphenicol or nalidixic acid, etc. to media, fibrous bacterial cellulose as wide as about 1000 nm having the same thickness as before can be produced (U.S. Pat. Ser. No. 09/436,756). Also, by adding an organic reducing material such as dithiothreitol, etc., narrower fibrous bacterial cellulose can be obtained.

The bacterial celluloses used in the present invention may be purified products separated from cultivated products of microorganism or those containing impurities depending on applications. For instance, sugars, salts, yeast extracts, etc. remaining in the cultivation liquids may be contained in the microorganism celluloses. Also, fungi may exist in the bacterial celluloses to some extent.

The gel-like bacterial cellulose is separated and washed with water. The washing water may contain agents such as germicides, pretreatment agents, etc. depending on purposes.

After washing, the bacterial cellulose is dried, or mixed with other materials and then dried. Though drying may be carried out by any method, it is of course noted that it should be conducted in a temperature range in which the cellulose does not decompose. Because the bacterial cellulose is composed of fine fibers having many hydroxyl groups on a surface, the fibers are attached to each other during drying, resulting in losing the fibrous shape. Accordingly, such methods as freeze drying, critical point desiccation, etc. are desirably used.

To prevent interconnection of the bacterial cellulose fibers and thus disperse them in the sizing agent, the bacterial cellulose in a gel state is preferably finely pulverized to provide a slurry or powder by drying. The pulverization method of the bacterial cellulose is not restrictive, and a method of rotating the bacterial cellulose gel in water by a homogenizer disclosed in Japanese Patent Laid-Open No. 5-51885, and a method of subjecting the bacterial cellulose gel to a hydrolysis with acid according to Japanese Patent Publication No. 5-80484 and then to mechanical shearing may be used.

On the other hand, the plant-originated fine fibrous cellulose is cellulose obtained by highly pulverizing or wearing wood, etc. For instance, cellulose fibers such as pulp fibers are crushed or pulverized by a ball mill, etc., or pulverized under pressure or by sound wave in water (Japanese Patent Publication Nos. 48-6641 and 50-38720, Japanese Patent Laid-Open No. 8-284090). Also, celluloses of sugar beet, citrus fruits and other parenchyma (soft tissue) cells than wood pulp may be pulverized according to a method of Japanese Patent Laid-Open No. 59-80402 or "CELLULOSE" 1996, 3, pp. 183–188. Thus, the microfibril of the plant-originated fine fibrous cellulose is provided with an average diameter of 10 $\mu$m or less (British Patent 2,066,145), preferably 1 nm to 2.0 $\mu$m, more preferably 1–100 nm.

(2) Cationic Polymer

The cationic polymer is a component contributing to fixing and color development of ink. Coloring materials contained in the ink are associated with the cationic polymer in the recording paper due to ionic interaction during penetration into the inside of the paper, causing instantaneous separation from a liquid phase, thereby further improving the fixing and color development of the ink.

The cationic polymer usable in the present invention is a hydrophilic resin having a structure unit comprising a cation group, specifically hydrophilic synthetic resins such as polyacrylic resins, polyvinyl resins, polyallyl resins, etc. and natural-occurring resins such as cationized starch, etc. The cationic groups are not restrictive as long as they have affinity for ink for inkjet printers. Particularly preferable among them are hydrophilic acrylic resins having quaternary amino groups as cationic groups.

The hydrophilic acrylic polymer having a quaternary amino group can be produced by including (i) a structure unit having a quaternary amino group as an indispensable structure unit, and as optional components (ii) a structure unit derived from a hydrophilic acrylic, vinyl or allyl monomer, and/or (iii) a structure unit derived from a hydrophobic monomer.

The structure units (i)–(iii) will be explained in detail below.

(i) Structure Unit Having Quaternary Amino Group

The structure unit (i) is a segment contributing to the fixing of a dye. Here, the quaternary amino group is represented by the following general formula:

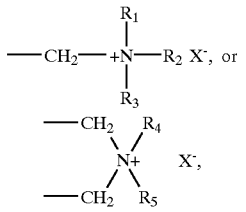

wherein $R_1$–$R_5$ are groups selected from the group consisting of alkyl groups having 1–7 carbon atoms, aryl groups, benzyl groups and combinations thereof, which may be the same or different, and X is a counter ion such as a halogen group, etc.

The quaternary amino group can be obtained by adding a halogenated alkyl, etc. to an alkyl amino group. Specific examples of monomers forming the structure unit (i) are preferably N,N-dimethylaminoethyl (meth)acrylate.methyl chloride, N,N-dimethylaminopropyl (meth) acrylamide.methyl chloride, N,N-diallylmethylamine-methyl chloride, etc.

(ii) Structure Unit Derived from Hydrophilic Acrylic, Vinyl or Allyl Monomer

The structure unit (ii) is a segment quickly absorbing water and a dye dissolved or dispersed in water. Specific examples of monomers forming the structure unit (ii) are preferably 1. Aliphatic carboxylic acids or anhydrides thereof such as acrylic acid, methacrylic acid, maleic acid, fumaric acid, itaconic acid, maleic anhydride, fumaric anhydride, itaconic anhydride, etc.;
2. Acrylamides such as (meth)acrylamide, dimethyl (meth) acrylamide, diethyl (meth)acrylamide, (meth)acryloil morpholine, N,N-dimethylaminopropyl (meth) acrylamide, N,N-diethylaminopropyl (meth)acrylamide, (meth)acrylamide-t-butyl sulfonic acid, etc.;
3. Phosphoric acid group-containing acrylic monomers such as mono(2-methacryloiloxyethyl) acid phosphate, mono (2-acryloiloxyethyl) acid phosphate, etc.; and
4. Vinylpyrrolidones such as N-vinyl-2-pyrrolidone, etc.

(iii) Structure Unit Derived from Hydrophobic Monomer

The structure unit (iii) is a segment imparting water resistance to the cationic polymer, which may be included in such a range as not to extremely hinder the hydrophilic properties of the cationic polymer. Monomers forming the structure unit (iii) are not particularly restrictive as long as they do not contain hydrophilic groups. Also, even monomers having hydrophilic groups (—OH, etc.) or hydrophilic portions (—O—, etc.) can form a hydrophobic portion of the cationic polymer, as long as they have hydrophobic groups having 4 or more carbon atoms. The number of carbon atoms in such hydrophobic groups is preferably 6 or more. Specific examples of such hydrophobic groups are long-chain alkyl groups, long-chain alkylene groups, aromatic groups, etc.

(iv) Percentage of Each Structure Unit

The percentages of the above structure units (i)–(iii), ratios of monomers used, are preferably such that (i) is 30–100% by weight, (ii) is 0–50% by weight, and (iii) is 0–30% by weight, more preferably that (i) is 70–100% by weight, (ii) is 0–30% by weight, and (iii) is 0–20% by weight.

(v) Addition of Cationic Polymer

The cationic polymer may simply be mixed with the surface-sizing agent of the present invention, though most of the cationic polymer penetrates into the inside of the raw paper, resulting in low yield. Therefore, the cationic polymer is preferably fixed to the bacteria cellulose. This leaves the cationic polymer near a paper surface together with the bacteria cellulose, making it possible to obtain excellent effects with a smaller amount of the cationic polymer. To bond the cationic polymer to the fine fibrous cellulose, the cationic polymer may be graft-polymerized to the fine fibrous cellulose by reaction of the cationic polymer in a state of monomer and a known polymerization initiator with the fine fibrous cellulose.

(3) Composition of Surface-sizing Agent

In the surface-sizing agent of the present invention, a weight ratio of the bacterial cellulose to the cationic polymer is 1:0.1 to 1:50, preferably 1:1 to 1:10, more preferably 1:1 to 1:3.

The mixture of the above components is diluted with a solvent such as water to a concentration suitable for sizing. The concentration of the surface-sizing agent is preferably 0.1–30%, more preferably 1–15% by weight on a dry solid basis.

(4) Other Components

The surface-sizing agent of the present invention may include, if necessary, other components than the fine fibrous cellulose and the cationic polymer in ranges as not to deteriorate the effects of the present invention. The other components added to the surface-sizing agent are alumina powder, silica powder, natural inorganic powder, water-soluble resins, resin emulsions, surfactants, pH-adjusting agents, antiseptics, anti-oxidants, etc.

The water-soluble resins may be, for instance, starch, polyacrylamide, polyvinyl pyrrolidone, polyvinyl methylether, polyethylene oxide, polyvinyl alcohol, etc.

Specific examples of the usable surfactants are adducts of higher alcohols and ethylene oxide, adducts of alkyl phenols and ethylene oxide, adducts of aliphatic acids and ethylene oxide, adducts of polyvalent alcohol aliphatic esters and ethylene oxide, adducts of higher alkyl amines and ethylene oxide, adducts of aliphatic amides and ethylene oxide, adducts of oils and ethylene oxide, adducts of polypropylene glycol and ethylene oxide, aliphatic esters of glycerol, aliphatic esters of pentaerythritol, aliphatic esters of sorbitol or sorbitan, aliphatic esters of sucrose, alkyl ethers of polyvalent alcohols, aliphatic amides of alkanol amines, etc., though they are not restrictive. Surfactants may be added to the ink to provide the ink with higher image concentration and improved resistance to bleeding.

[B] Recording Paper

The recording paper of the present invention is a paper impregnated or coated with the surface-sizing agent of the present invention at the stage of a raw paper or in a paper-producing process, and sizing may be carried out on a single surface or both surfaces of the raw paper. The sizing forms a fine network of the fine fibrous cellulose on a paper surface, leading to suppression of feathering. Also, the dye is associated with the cationic polymer by ionic interaction near a surface of the recording paper, resulting in instantaneous separation from the liquid phase. Thus, the fixing and color development of ink is further improved.

The raw paper used in the present invention is based on chemical pulp such as LBKP, NBKP, etc. and fillers, including an inner surface-sizing agent and a paper-producing aide, if necessary. The raw paper is formed into a plain paper by a usual method. Pulp usable in the present invention may be mechanical pulp or pulp regenerated from used papers, or pulp containing them as main components. The fillers may be calcium carbonate, kaolin, talc, titanium dioxide, etc.

The surface-sizing agent of the present invention is applied or impregnated to the above raw paper in an amount of 0.1–20 g/m$^2$, preferably 1–10 g/m on a solid basis.

The recording paper treated with the surface-sizing agent of the present invention is preferably adjusted to have a water extraction pH of 5–9, more preferably 6–8. The water extraction pH is defined as pH (measured according to JIS-Z-8802) of an extract obtained by immersing 1.0 g of a test piece (defined by JIS-P-8133) in 70 ml of distilled water.

The recording paper of the present invention is not substantially different from conventional neutral PPC papers with respect to surface conditions and physical properties except for recording properties. Therefore, the recording papers of the present invention can be used as toner-bearing papers for electrophotography and inkjet printing papers.

The present invention will be explained in further detail by the following EXAMPLES without intention of restricting the scope of the present invention defined by the claims attached hereto.

EXAMPLE 1

A 2-weight % aqueous solution of bacterial cellulose produced by stationary culture and consisting of microfibril of 5 nm thick and 130 nm wide on average was rotated at a high speed of about 20,000 rpm for 30 minutes by a homogenizer so that the bacterial cellulose was pulverized.

10 parts by weight of the finely pulverized bacterial cellulose and 10 parts by weight of N,N-dimethylaminoethyl acrylate.methyl chloride were dissolved in 80 parts by weight of water, and a polymerization catalyst was added in an amount of 0.5 % by weight based on N,N-dimethylaminoethyl acrylate-methyl chloride to carry out their reaction at 60° C. for 8 hours.

8 parts (on a solid basis) of the above reaction product and 2 parts by weight of alumina ("AES-12," available from Sumitomo Chemical Industries Co., Ltd.) were dissolved in 90 parts by weight of water to prepare a surface-sizing agent, which was applied to a raw paper having a basis weight of 70 g/m$^2$ by a bar coater in an amount of about 2 g/m$^2$ on a solid basis, and dried at 120° C. for 5 minutes in an oven.

EXAMPLE 2

5 parts by weight of the finely pulverized bacterial cellulose in EXAMPLE 1 and 15 parts by weight of N,N-dimethylaminoethyl acrylate.methyl chloride were dissolved in 80 parts by weight of water, and a polymerization catalyst was added in an amount of 0.5% by weight based on N,N-dimethylaminoethyl acrylate-methyl chloride to carry out their reaction at 60° C. for 8 hours.

8 parts (on a solid basis) of the above reaction product and 2 parts by weight of alumina ("AES-12," available from Sumitomo Chemical Industries Co., Ltd.) were dissolved in 90 parts by weight of water to prepare a surface-sizing agent, which was applied to a raw paper having a basis weight of 70 g/m$^2$ by a bar coater in an amount of about 2 g/m$^2$ on a solid basis, and dried at 120° C. for 5 minutes in an oven.

EXAMPLE 3

10 parts by weight of the finely pulverized bacterial cellulose in EXAMPLE 1 and 10 parts by weight of N,N-diallylmethylamine.methyl chloride were dissolved in 80 parts by weight of water, and a polymerization catalyst was added in an amount of 0.5% by weight based on N,N-diallylmethylamine-methyl chloride to carry out their reaction at 60° C. for 8 hours.

8 parts (on a solid basis) of the above reaction product and 2 parts by weight of alumina ("AES-12," available from Sumitomo Chemical Industries Co., Ltd.) were dissolved in 90 parts by weight of water to prepare a surface-sizing agent, which was applied to a raw paper having a basis weight of 70 g/m$^2$ by a bar coater in an amount of about 2 g/m$^2$ on a solid basis, and dried at 120° C. for 5 minutes in an oven.

EXAMPLE 4

5 parts by weight of the finely pulverized bacterial cellulose in EXAMPLE 1 and 15 parts by weight of N,N-diallylmethylamine.methyl chloride were dissolved in 80 parts by weight of water, and a polymerization catalyst was added in an amount of 0.5% by weight based on N,N-diallylmethylamine.methyl chloride to carry out their reaction at 60° C. for 8 hours.

8 parts (on a solid basis) of the above reaction product and 2 parts by weight of alumina ("AES-12," available from Sumitomo Chemical Industries Co., Ltd.) were dissolved in 90 parts by weight of water to prepare a surface-sizing agent, which was applied to a raw paper having a basis weight of 70 g/m$^2$ by a bar coater in an amount of about 2 g/m$^2$ on a solid basis, and dried at 120° C. for 5 minutes in an oven.

EXAMPLE 5

N,N-diallylmethylamine.methyl chloride was polymerized in a concentration of 30% by weight to prepare a cationic polymer.

4 parts (on a solid basis) of the bacterial cellulose prepared in EXAMPLE 1, 4 parts (on a solid basis) of the above cationic polymer and 2 parts by weight of alumina ("AES-12," available from Sumitomo Chemical Industries Co., Ltd.) were dissolved in 90 parts by weight of water to prepare a surface-sizing agent, which was applied to a raw paper having a basis weight of 70 g/m$^2$ by a bar coater in an amount of about 2 g/m$^2$ on a solid basis, and dried at 120° C. for 5 minutes in an oven.

EXAMPLE 6

A recording paper was produced in the same manner as in EXAMPLE 5 except for using 2 parts by weight of the bacterial cellulose and 6 parts by weight of the cationic polymer both on a solid basis.

EXAMPLE 7

A mixture of 70 parts by weight of N,N-dimethylaminoethyl acrylate.methyl chloride and 30 parts by weight of dimethyl acrylamide was polymerized in a concentration of 15% by weight to prepare a viscous cationic polymer.

4 parts (on a solid basis) of the bacterial cellulose prepared in EXAMPLE 1, 4 parts (on a solid basis) of the above cationic polymer and 2 parts by weight of alumina ("AES-12," available from Sumitomo Chemical Industries Co., Ltd.) were dissolved in 90 parts by weight of water to prepare a surface-sizing agent, which was applied to a raw paper having a basis weight of 70 g/m$^2$ by a bar coater in an amount of about 2 g/m$^2$ on a solid basis, and dried at 120° C. for 5 minutes in an oven.

EXAMPLE 8

A recording paper was produced in the same manner as in EXAMPLE 7 except for using 2 parts by weight of the bacterial cellulose and 6 parts by weight of the cationic polymer both on a solid basis.

EXAMPLES 9–12

A 2-weight % aqueous solution of parenchyma cell cellulose of sugar beet was stirred at 60° C. for 15 minutes in a blender to prepare a suspension, which was treated at 500 bar and at 90–95° C. 15 times by a homogenizer (available from Manton Gaulin Laboratory) to prepare plant-originated fine fibrous cellulose having an average diameter of about 4 nm.

Recording papers were produced in the same manner as in EXAMPLES 1–4 except for using the above plant-originated fine fibrous cellulose instead of the bacterial cellulose.

Comparative Example 1

8 parts by weight of the bacterial cellulose prepared in EXAMPLE 1 and 2 parts by weight of alumina ("AES-12," available from Sumitomo Chemical Industries Co., Ltd.) were dissolved in 90 parts by weight of water to prepare a surface-sizing agent, which was applied to a raw paper having a basis weight of 70 g/m$^2$ by a bar coater in an amount of about 2 g/m$^2$ on a solid basis, and dried at 120° C. for 5 minutes in an oven.

Comparative Example 2

8 parts by weight of the plant-originated fine fibrous cellulose used in EXAMPLE 9 and 2 parts by weight of alumina ("AES-12," available from Sumitomo Chemical Industries Co., Ltd.) were dissolved in 90 parts by weight of water to prepare a surface-sizing agent, which was applied to a raw paper having a basis weight of 70 g/m$^2$ by a bar coater in an amount of about 2 g/m$^2$ on a solid basis, and dried at 120° C. for 5 minutes in an oven.

Comparative Example 3

8 parts by weight of the cationic polymer prepared in EXAMPLE 5 and 2 parts by weight of alumina ("AES-12," available from Sumitomo Chemical Industries Co., Ltd.) were dissolved in 90 parts by weight of water to prepare a surface-sizing agent, which was applied to a raw paper having a basis weight of 70 g/m$^2$ by a bar coater in an amount of about 2 g/m$^2$ on a solid basis, and dried at 120° C. for 5 minutes in an oven.

TABLE 1

Compositions of Surface-Sizing Agents (parts by weight)

| No. | Cellulose | Cationic Polymer | Alumina | Water |
|---|---|---|---|---|
| EXAMPLE 1 | BC (4) | A* (4) | 2 | 90 |
| EXAMPLE 2 | BC (2) | A* (6) | 2 | 90 |
| EXAMPLE 3 | BC (4) | B* (4) | 2 | 90 |
| EXAMPLE 4 | BC (2) | B* (6) | 2 | 90 |
| EXAMPLE 5 | BC (4) | B (4) | 2 | 90 |
| EXAMPLE 6 | BC (2) | B (6) | 2 | 90 |
| EXAMPLE 7 | BC (4) | C (4) | 2 | 90 |
| EXAMPLE 8 | BC (2) | C (6) | 2 | 90 |
| EXAMPLE 9 | MFC (4) | A* (4) | 2 | 90 |
| EXAMPLE 10 | MFC (2) | A* (6) | 2 | 90 |
| EXAMPLE 11 | MFC (4) | B* (4) | 2 | 90 |
| EXAMPLE 12 | MFC (2) | B* (6) | 2 | 90 |
| Com. Ex. 1 | BC (8) | — | 2 | 90 |
| Com. Ex. 2 | MFC (8) | — | 2 | 90 |
| Com. Ex. 3 | — | B (8) | 2 | 90 |

Note:
BC: Bacterial cellulose.
MFC: Plant-originated fine fibrous cellulose.
A: Polymer of N,N-dimethylaminoethyl acrylate methyl chloride.
B: Polymer of N,N-diallymethylamine methyl chloride.
C: Copolymer of N,N-dimethylaminoethyl acrylate methyl chloride and dimethyl acrylamide at a ratio of 7:3.
*Graft polymer obtained by bonding a cationic polymer to cellulose.

Comparative Example 4

A commercially available coated paper ("High-Grade Paper for IJ Printer," available from KOKUYO) was used in COMPARATIVE EXAMPLE 4.

Each recording paper obtained in EXAMPLES 1–12 and COMPARATIVE EXAMPLES 1–4 was used for full-color printing with an inkjet printer (color bubble-jet printer "BJF 600," available from Canon Inc.). Each printed sample was evaluated with respect to recorded image. The results are shown in Table 2.

TABLE 2

Evaluation Results

| | Basis | Printed Letters | | Color Development(3) | | | |
|---|---|---|---|---|---|---|---|
| No. | Weight (g/m$^2$) | Line Width (mm)(1) | Ratio(2) | Red | Yel-low | Blue | Black |
| EXAMPLE 1 | 71.1 | 10.5 | 1.31 | ○ | ○ | ○ | ○ |
| EXAMPLE 2 | 71.8 | 11.2 | 1.40 | ○ | ○ | ○ | ○ |
| EXAMPLE 3 | 72.0 | 11.5 | 1.44 | ○ | ○ | ○ | Δ |
| EXAMPLE 4 | 71.5 | 10.8 | 1.35 | ○ | ○ | ○ | ○ |
| EXAMPLE 5 | 70.9 | 13.6 | 1.70 | ○ | ○ | ○ | Δ |
| EXAMPLE 6 | 71.7 | 11.0 | 1.38 | ○ | ○ | ○ | Δ |
| EXAMPLE 7 | 72.2 | 10.3 | 1.29 | ○ | ○ | ○ | Δ |
| EXAMPLE 8 | 71.7 | 15.5 | 1.93 | ○ | ○ | ○ | Δ |
| EXAMPLE 9 | 71.9 | 11.2 | 1.40 | ○ | ○ | ○ | ○ |
| EXAMPLE 10 | 72.0 | 11.7 | 1.46 | ○ | ○ | ○ | ○ |
| EXAMPLE 11 | 71.7 | 12.5 | 1.56 | ○ | ○ | ○ | Δ |
| EXAMPLE 12 | 72.2 | 11.3 | 1.41 | ○ | ○ | ○ | ○ |
| Com. Ex. 1 | 72.1 | 15.2 | 1.80 | Δ | ○ | X | X |
| Com. Ex. 2 | 72.0 | 15.2 | 1.90 | Δ | ○ | X | X |
| Com. Ex. 3 | 74.9 | 17.0 | 2.13 | Δ | ○ | X | X |
| Com. Ex. 4 | 134.0 | 8.0 | 1.00 | ○ | ○ | ○ | ○ |

Note:
(1)The sum of line width w observed by a microscope on three small pieces of 1 cm wide cut from papers printed in a pattern shown in FIG. 1.
(2)A ratio of the line width of each test piece to the line with of a commercially available coated paper in COMPARATIVE EXAMPLE 4.
(3)The color development of ink.

As is clear from Table 2, EXAMPLES 1–12 are narrower in the width of printed letters and better in the characteristics of printed letters than COMPARATIVE EXAMPLES 1–3. EXAMPLES 1–4 and 9–12 using the cellulose coupled with the cationic polymer are excellent in color development in every color, not poorer than the coated paper of COMPARATIVE EXAMPLE 4. Comparing EXAMPLES 1–4 in which the cationic polymer was bonded to the cellulose with EXAMPLES 5–8 in which the cationic polymer was not bonded to the cellulose, it has been found that better color development is achieved by the bonding of the cationic polymer to the cellulose. This appears to be due to the fact that the bonding of the cationic polymer to the cellulose makes it difficult for the cationic polymer to penetrate into the inside of the raw paper. Comparison of EXAMPLES 1–4 in which the bacterial cellulose was used with EXAMPLES 9–12 in which the plant-originated fine fibrous cellulose was used revealed that fewer ink blurring was appreciated when the bacterial cellulose was used. This appears to be due to the fact that there is little unevenness in the thickness of fibers in the bacterial cellulose.

As described in detail above, the surface-sizing agent of the present invention can provide inexpensive, high-performance recording papers particularly suitable for full-color inkjet printing. Because the recording papers of the present invention are not subjected to drastic modifications in surface conditions and physical properties unlike the coated papers, they can be used as toner-bearing papers for electrophotography and as inkjet printing papers.

What is claimed is:

1. A recording paper comprising a raw paper mainly comprising fibrous pulp and a filler and sized with a surface-sizing agent, said surface-sizing agent comprising bacterial cellulose and/or plant-originated fine fibrous cellulose (having an average diameter of 10 μm or less), and a cationic polymer, said cationic polymer being hydrophilic and having cationic groups exhibiting an affinity for the ink used for jet printers, wherein a weight ratio of said bacterial cellulose to said cationic polymer is 1:0.1 to 1:50.

2. The recording paper according to claim 1, wherein said bacterial cellulose is composed of ribbon-shaped microfibril of 1–20 nm in thickness and 10 nm to 1 μm in width.

3. The recording paper according to claim 1, wherein said plant-originated fine fibrous cellulose has microfibril having an average diameter of 10 μm or less.

4. The recording paper according to claim 1, wherein cationic polymer is at least partially bonded to said bacterial cellulose and/or said plant-originated fine fibrous cellulose.

5. The recording paper according to claim 1, wherein said cationic polymer is an acrylic polymer, a vinyl polymer or an allyl polymer each comprising a quaternary amino group.

6. The recording paper according to claim 1, wherein said raw paper is coated or impregnated with said surface-sizing agent in an amount of 0.1–20 $g/m^2$.

7. A surface-sizing agent comprising bacterial cellulose and/or plant-originated fine fibrous cellulose (having an average diameter of 10 μm or less), and a cationic polymer, said cationic polymer being hydrophilic and having cationic groups exhibiting an affinity for the ink used for jet printers, wherein a weight ratio of said bacterial cellulose to said cationic polymer is 1:0.1 to 1:50.

8. The surface-sizing agent according to claim 7, wherein said bacterial cellulose is composed of ribbon-shaped microfibril of 1–20 nm in thickness and 10 nm to 1 μm in width.

9. The surface-sizing agent according to claim 7, wherein said plant-originated fine fibrous cellulose has microfibril having an average diameter of 10 μm or less.

10. The surface-sizing agent according to claim 7, wherein cationic polymer is at least partially bonded to said bacterial cellulose and/or said plant-originated fine fibrous cellulose.

11. The surface-sizing agent according to claim 7, wherein said cationic polymer is an acrylic polymer, a vinyl polymer or an allyl polymer each comprising a quaternary amino group.

* * * * *